US005713314A

United States Patent [19]

Beare

[11] Patent Number: 5,713,314

[45] Date of Patent: Feb. 3, 1998

[54] DUAL PISTON INTERNAL COMBUSTION ENGINE

[76] Inventor: Malcolm J. Beare, "Wynkie Marsh", Bordertown 5268 South Australia, Australia

[21] Appl. No.: 793,308

[22] PCT Filed: Oct. 18, 1995

[86] PCT No.: PCT/AU95/00691

§ 371 Date: Mar. 12, 1997

§ 102(e) Date: Mar. 12, 1997

[87] PCT Pub. No.: WO96/12096

PCT Pub. Date: Apr. 25, 1996

[30] Foreign Application Priority Data

Oct. 18, 1994 [AU] Australia ..... PM8910

[51] Int. Cl.[6] ..... F02B 75/28

[52] U.S. Cl. ..... 123/51 R; 123/51 BA

[58] Field of Search ..... 123/51 R, 51 A, 123/51 AA, 51 B, 51 BA, 51 BD, 560

[56] References Cited

U.S. PATENT DOCUMENTS

| | | | |
|---|---|---|---|
| 1,237,696 | 8/1917 | Rayl | 123/51 AA |
| 1,339,187 | 5/1920 | Fite et al. . | |
| 1,590,940 | 6/1926 | Hallett . | |
| 1,707,005 | 3/1929 | Hall | 123/51 R |
| 1,719,752 | 7/1929 | Brown | 123/51 A |
| 1,914,707 | 6/1933 | Wolf | 123/51 AA |
| 2,153,899 | 4/1939 | Shover | 123/51 AA |
| 2,320,928 | 6/1943 | Henson | 123/51 A |
| 2,345,056 | 3/1944 | Mallory . | |
| 2,420,779 | 5/1947 | Holmes | 123/51 BA |
| 2,435,361 | 2/1948 | Mallory . | |
| 2,442,302 | 5/1948 | Mallory . | |
| 2,473,759 | 6/1949 | Mallory . | |
| 2,495,978 | 1/1950 | Maxwell | 123/51 A |
| 2,541,594 | 2/1951 | Mallory | 123/51 BA |
| 2,937,630 | 5/1960 | Norton | 123/51 AA |
| 2,949,899 | 8/1960 | Jacklin | 123/51 BA |
| 3,868,931 | 3/1975 | Dutry et al. | 123/51 R |
| 5,083,530 | 1/1992 | Rassey | 123/51 R |

FOREIGN PATENT DOCUMENTS

| | | |
|---|---|---|
| 2480851 | 10/1981 | France . |
| 2633010 | 12/1989 | France . |
| 577234 | 5/1933 | Germany . |
| 61-190125 | 8/1986 | Japan . |

*Primary Examiner*—David A. Okonsky
*Attorney, Agent, or Firm*—McAulay Fisher Nissen Goldberg & Kiel, LLP

[57] ABSTRACT

An internal combustion engine (1) comprising at least two cylinders (4,8) meeting to form a combustion space (12) therebetween, a first piston (3) adapted to reciprocate within the first cylinder (4) and a second piston (7) adapted to reciprocate within the second cylinder (8). The two pistons are drivably coupled via a chain drive connecting their respective crankshafts and synchronously move one with respect to the other such that the second piston moves at a frequency haft of that of the first piston. An air/fuel mixture inlet aperture (14) as well as an exhaust aperture (15) are located in the wall of the second cylinder (8) and are opened or closed by the movement of the second piston (7). There is a further exhaust sealing valve (17) such as a rotary disc valve which opens or closes an exhaust port (16) connecting the exhaust aperture (15) to the outside (or exhaust system), the sealing valve (17) closing the exhaust port (16) so as to prevent exhaust gases from re-entering the combustion chamber (12) when the engine is in its intake stroke and when the exhaust aperture (15) is not covered by the second piston (7). The air/fuel mixture enters the combustion chamber (12) through a one-way valve (13), usually a reed valve.

29 Claims, 7 Drawing Sheets

*TDC 270°*

BDC 180°

90°

TDC 0°

TDC 490°

TDC 360°

TDC 270°

TDC 720°

630°

BDC 540°

DUAL PISTON INTERNAL COMBUSTION ENGINE

TECHNICAL FIELD

This invention is directed to an improvement in internal combustion engines. In particular this invention is for internal combustion engines containing two pistons per cylinder, a primary and a secondary piston, wherein the secondary piston cycles through at a frequency half of that of the primary piston.

BACKGROUND ART

For a number of years now internal combustion engines have been developed which provide power from fuels such as petrol, diesel and gas, and convert it into a form, usually rotational or linear motion, which can then be used to power an enormous range of diverse applications such as ships, automobiles, motorcycles, electrical generators and even chainsaws. In its basic form an internal combustion engine converts chemical energy into kinetic energy, by burning of fuels.

A lot of research and development has been expended on internal combustion engines resulting in a large diversity of designs. Some of these include the four-stroke, two-stroke, rotary, and sleeve-valve type engines. The aim of all this research and development has been to improve the efficiency of engines and increase the power to weight ratio, to make the engines more reliable and robust, and to increase their power band range.

The easiest way to increase the power of an engine is to simply increase its capacity or displacement. However, for an engine of a given size there are various other factors which can increase the power. For an engine of a particular size the power available is a function of the pressure within the cylinder during the power stroke, the rate of the power strokes (commonly known as revolutions per minute), the friction in the engine and the volumetric efficiency. Therefore, either by increasing the pressure, increasing the revolutions per minute, increasing the length of the power stroke, decreasing the friction, or increasing the volumetric efficiency, the power of an engine can be improved. There are limitations on changing some of the above parameters. For example, increasing pressure is limited due to thermal considerations and by the ability of the engine to recharge the cylinder with a fresh air/fuel mixture between power strokes. Increasing the revolutions per minute is also limited due to mechanical constraints such as inertial loadings on the valves, bearings, rods and pistons, while increasing the length of the power strokes is limited by inertial loadings on the crankshaft.

This invention is directed to improving the power of an engine for a given capacity by changing some of the above parameters which collectively determine the power of an engine. This invention is directed towards a four-stroke engine.

DISCLOSURE OF THE INVENTION

Therefore in one form of the invention although this need not be the only or indeed the broadest form there is proposed an internal combustion engine comprising of;

- two cylinders co-axially aligned and meeting to form a combustion space therebetween;
- a first piston adapted to reciprocate within the first cylinder;
- a second piston adapted to reciprocate within the second cylinder;

- the said two pistons being drivably coupled so as to synchronously move one with respect to the other such that the second piston moves at a frequency half of that of the first piston;
- means for providing for an air/fuel mixture inlet through a first aperture or apertures in the wall of the second cylinder;
- means for providing an exhaust outlet through a second aperture or apertures in the wall of the second cylinder;
- a timed exhaust sealing valve within the exhaust outlet to effect an opening or closing of the exhaust outlet at a selected time in the operating cycle of the engine; and
- the apertures being positioned so as to be opened or closed by covering and uncovering of the apertures by the movement of the second piston.

In preference the exhaust sealing valve is a disc-type rotary valve.

This type of exhaust valve arrangement eliminates a popper valve. This increases volumetric efficiency since there is no valve in the way of the exhaust gas flow. This also reduces valve stresses and eliminates valve hot spotting which occurs in a poppet valve as heat can only be dissipated along the narrow stem of the valve causing it to be thermally stressed. In addition, a poppet valve operates by extending into the combustion space which requires power when the combustion space is under compression. The disc-type rotary valve improves mechanical efficiency since no power is expended working against the compression.

In preference at least a part of the second aperture or apertures is so positioned on the wall of the second cylinder whereby when the said part is uncovered by the second piston the second piston covers all of the inlet aperture or apertures.

In preference the said part of the second aperture or apertures is located lower on the wall of the second cylinder than the first aperture or apertures.

In preference the disc-type rotary valve is constructed from a suitable material such as ceramic coated plastic although other materials such as Aluminium or Titanium may be used. The material to be used may be dictated by the stresses that the engine may be subjected to and the expected revolutions per minute that the engine may reach as well as the fuel that is to be used since that can have an effect on the operating temperature of the engine. Of course, the total cost of production will be a determining factor in some instances depending on what the proposed application of the engine is.

To overcome frictional losses by the disc-type rotary valve rubbing against the outside wall of the cylinder, the exhaust port preferentially protrudes somewhat from the body of the cylinder, the result being that the disc-type rotary valve only rubs against that protrusion. In preference this protrusion is ceramic, although other suitable materials such as brass may be employed.

The material that the protrusion is to be constructed from will be chosen solely on the basis of its properties. Thus, brass may be a preferred material since it is relatively soft and will not damage the disc-type rotary valve. But the wear may be minimal since it is the centifugal force that acts so as to keep the rotary valve in position and the disc only just touches the protrusion lightly.

Since during the operating cycle there are times when both the first and second apertures are uncovered by the second piston, to prevent the exhaust gases flowing through the inlet valve, the air/fuel mixture inlet further comprising inlet valve that is preferentially a one-way valve such as a reed valve, or a rotary disc valve.

The exhaust and inlet apertures are preferentially circular in shape although other shapes, such as elliptical can be employed, the shape only limited by the mechanical tolerances, such as the rings in the second piston.

In preference there is at least one spark plug adapted to ignite the air/fuel mixture in the combustion space, although the engine could be modified to use diesel fuel which ignites due to compression only, or could be modified to use more than one spark plug in the combustion space.

In preference the air/fuel inlet aperture has a construction allowing selective charging of the combustion space, such as stratified charging.

Stratified charging is a means of admitting air to the combustion space, also known as the chamber, so that it is warmed and leans the centre volume of the chamber. A small tube or a passageway can extend into the exhaust outlet between the second aperture or apertures and the rotary disc valve. This tube or passageway enters the exhaust outlet in such a direction so as to create a swirl of air around the walls of the exhaust outlet so that when the air enters the combustion space or chamber it is swirling in a substantially opposite direction to the air/fuel mixture from the inlet first aperture or apertures. The majority of the air/fuel mixture stream is directed to substantially adhere to the combustion space walls and go below the exhaust aperture. However a small proportion of the air then flows to the exhaust outlet from the small tube and enters the combustion space above the main intake air/fuel mixture flow swirling at a lower velocity in the opposite direction to the major air/fuel stream. Therefore it substantially ends up in the centre of the chamber or combustion space albeit mixed with a percentage of the main air/fuel mixture stream thus leaning it. It is well known that a warmer lean mixture will extend the lean flammability limit and therefore decrease the amount of hydrocarbons left following the combustion process. The added benefit in the case of this invention is that the fuel/air mixture stream also acts so as to keep the rotary disc valve and the exhaust outlets cooler.

The small tube or passageway must also have a small valve, such as a reed valve, to prevent back flow of gases up the exhaust outlet. When the rotary disc valve closes the exhaust outlet the negative pressure of the intake stroke of the engine will draw air through the reed valve and the tube.

Further upstream of that reed valve is a butterfly valve which can be operated by a number of means such as a cable, in such a manner as to rotate up to 180° when the main throttle has been increased from idle to full open. Therefore, at idling the air flow is restricted in the small tube since the butterfly valve is substantially closed. At approximately half throttle the butterfly valve is fully open and the air flow is at its maximum; this roughly corresponds to the cruising speed of vehicles. However, at full throttle when most power is required the air flow through the small tube is restricted by the closure of the butterfly valve allowing a homogenous mixture in the combustion space. The addition of the butterfly valve also means that at idling the air/fuel mixture is not overlean by closure of the butterfly valve.

In preference the second said piston is cylindrical and has a diameter which is between 50 to 70 percent of the diameter of the said first piston.

In preference the length of the stroke of the said second piston is between 25 to 50 percent the length of the stroke of the said first piston.

In preference the crown of the first said piston is flat so as to minimise thermal losses, but is not limited to that shape as other shapes may be employed to change various engine characteristics such as compression ratio.

In preference the crown of the said second piston is conical. Such a shaping helps to perpetuate the swirl of the incoming air/fuel mixture in a wall adhered downward spiral.

In preference the said second piston is connected to a crankshaft which lies within the piston skirt. In such an arrangement the con rod is connected away from the piston crown. Although this increases the length of the second piston skirt, it moves the position of the second piston crankshaft towards the combustion space thereby reducing the size of the diameter of the exhaust disc-type rotary sealing valve and the inlet rotary disc valve.

The cooling, lubrication and sealing of the engine may be preferably accomplished using any suitable means.

The disc type rotary valves can be preferentially used with both the intake and the exhaust outlets. They are positioned approximately 90° to the axis of the second piston crank shaft with a 2 to 1 right angle drive on the end of the crank shaft. This cross shaft is linked at a one end to the exhaust rotary disc valve, or valves in the case of multiple cylinders by either a chain or a tooth belt, while on its other end it is linked to the intake rotary disc valve or valves in the case of multiple cylinders. A major advantage of this type of arrangement is the low requirement for power due to the low speed, and the ability to adapt to in-line engines such as 6 or 4 or V8 to mention a few. For added balance the rotary disc valves can be shaped so as to offer a counterbalance. In that case the speed of the crank shaft driving the disc rotary valves is 4:1 drive as opposed to the 2:1 drive if the rotary valves are not of the "butterfly" arrangement. It is to be remembered that reed valves will be quite acceptable for stationary engines and diesels whilst high performance engines might prefer rotary disc valves which allow superior gas flow.

It is envisaged that a standard conventional four-stroke engine could be easily modified to the abovementioned arrangement. This is particularly attractive as it allows existing engines which are adapted to run on liquid fuels such as petroleum with the addition of tetra ethyl lead (added to offset the problem of detonation and excessive pressure build up) to be run on unleaded petrol. Although engines can be modified to run on unleaded fuel, this necessitates changing the poppet valves to hardened types in conjunction with hardened seals. By eliminating the poppet valve unleaded petrol can be used even with an increase in compression pressure.

In a fundamental form, this engine employs the same basic design for the crankcase and the first piston arrangement as in a conventional four-stroke engine. However, instead of the usual poppet valve arrangement as is found on conventional four-stroke engines with one piston per cylinder, the cylinder head is adapted to use a second piston in an arrangement where the second piston moves in unison with the main piston at half the frequency of the main piston. This second piston performs several functions. It increases the compression ratio and acts as a valve arrangement by uncovering the input and output ports which are apertures in the cylinder. The increase in compression acts to increase the power output. However, by eliminating the need for poppet valves not only does the volumetric efficiency increase, but the energy used in a conventional four-stroke engine to drive the valves is no longer expended. Without the poppet valves, the acoustic properties of the engine also change and make the engine quieter. With both pistons providing power at the power stroke, the length of the piston stroke also effectively increases.

This type of engine design can be termed an opposed piston six-stroke engine.

BRIEF DESCRIPTION OF THE DRAWINGS

To enable the invention to be fully understood a preferred embodiment of the invention will now be described with reference to the following drawings where.

BEST MODE OF CARRYING OUT THE INVENTION

Figure 3:
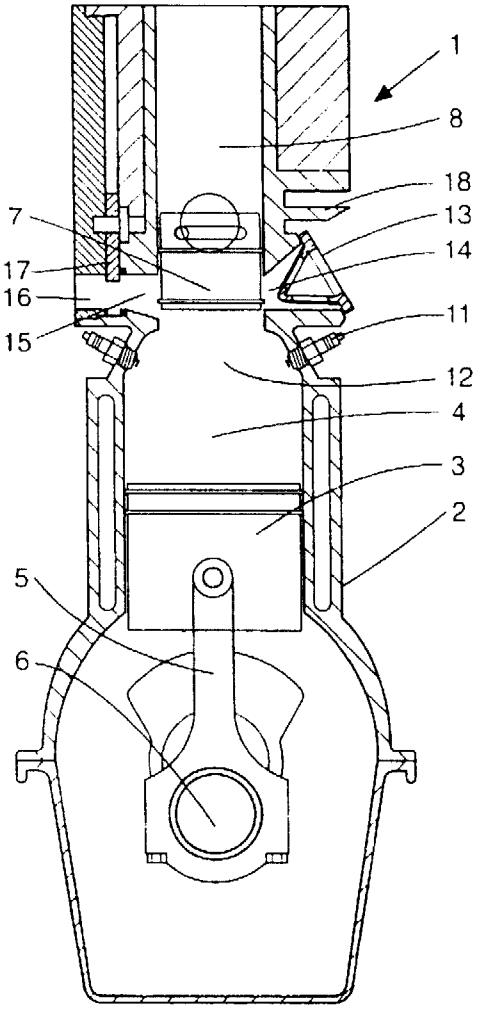
FIG. 3 is the cross-section of the engine as in FIG. 1 but with the first crankshaft at 180 degrees rotation.

Turning now to the figures in detail there is shown in FIGS. 1–9 a cross-sectional view of the engine at various stages through one cycle of operation of one preferred embodiment of the invention. The embodiment of the invention resides in an engine 1 being a two cylinder opposing engine with an engine block 2, with suitable cooling and lubrication passages (not shown), a first piston 3 within first cylinder 4 connected by a first connecting rod 5 to first crankshaft 6, second piston 7 located in second cylinder 8 connected by a second connecting rod 9 to second crankshaft 10. Spark plugs 11 acting in combustion space 12 ignite the air/fuel mixture (not shown) which enters the combustion space 12 through inlet valve 13, herein a reed valve, and through an inlet aperture 14 in second cylinder 8. The exhaust gases (not shown) are expelled through an exhaust aperture 15 in second cylinder 8 and then through exhaust port 16 which is selectively closable by rotary valve 17. Both the inlet aperture 14 and the exhaust aperture 15 are selectively closable by the second piston 7 which slidably moves within cylinder 8. The engine may be air cooled via air cooling fins 18. The first crankshaft 6 and second crankshaft 10 are mechanically coupled together by a chain drive (shown in FIGS. 12, 13) and geared so that the second crankshaft 10 rotates at half the angular velocity of the first crankshaft 6. In this way while the first piston 3 completes four strokes the second piston 7 only completes two strokes. The engine inlet aperture 13 and exhaust aperture 14 are covered and uncovered my the motion of the secondary piston.

Figure 1:
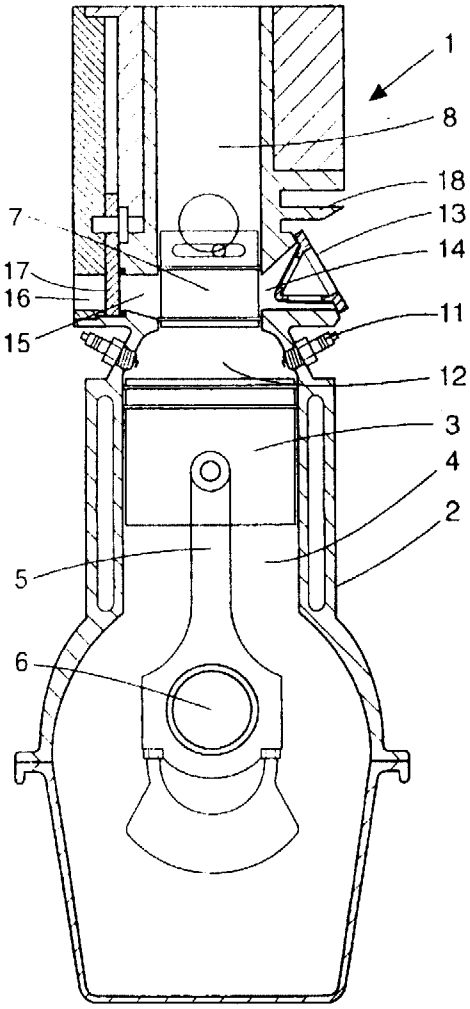
FIG. 1 is a cross-section of the engine showing the first (primary) piston and the secondary (Upper) piston when the primary piston is at Top Dead Centre (TDC) and the secondary piston is some 20 degrees after TDC.

Turning to the individual stages of the cycle there is shown in FIG. 1 the first piston 3 at TDC and the second piston 7 at approximately 20 degrees before its BDC. However, the relative position of the second piston is not set at 20 degrees relative to the main piston at TDC, for its position can be varied depending on the particular 'tuning' of the engine. It has empirically been found that an engine with the secondary piston at 20 degrees off-set to the main crankshaft at TDC does provide good performance, but different applications may require that position to be different.

At 0 degrees (all the following rotations will be generally referring to the position of the first crankshaft unless specifically referred to otherwise) as shown in FIG. 1 the combustion space 12 is fully charged by an air/fuel mixture (not shown) and is ignited by spark plugs 11. The burning of the air/fuel mixture increases the pressure in the combustion space 12 which forces the primary piston 3 downwards through cylinder 4 towards its BDC and the secondary piston 7 upwards through cylinder 8 to its TDC. This downward motion causes the first and second crankshafts 6 and 10 to rotate, the second crankshaft 10 rotating at half the angular velocity of crankshaft 6, the two crankshafts mechanically coupled by a geared chain. At the beginning of the cycle the primary piston 3 is at TDC while the secondary piston 7 is 20 degrees before its BDC, though this may not necessarily be the optimum configuration and the relative positions of the pistons may be varied. However, both the inlet aperture 14 and the outlet apertures 15 are closed by the secondary piston whilst the rotary sealing valve 17 is also closed (though need not be).

Figure 2:
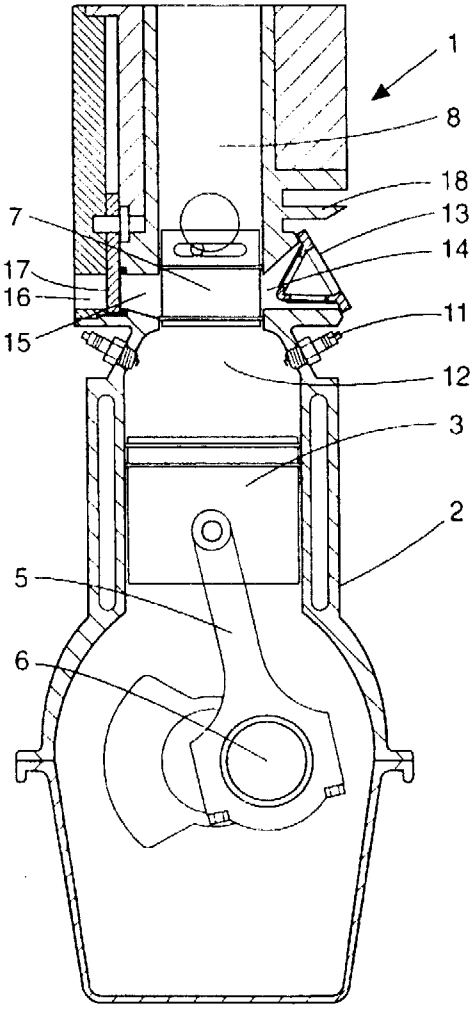
FIG. 2 is the cross-section of the engine as in FIG. 1 but with the first piston or crankshaft at approximately 90 degrees rotation.

FIG. 2 shows the engine 1 half way through completing its first stroke, the power stroke, with the first crankshaft 6 having rotated about 90 degrees and the second crankshaft 10 half that, about 45 degrees. The exhaust sealing valve 17 is closed with the secondary piston 7 at this stage still covering the inlet aperture 14 and the exhaust aperture 15. The force of the combustion thus still acts on both the primary and secondary pistons and produces the power of the engine.

FIG. 3 shows the engine when the first crankshaft has now rotated through 180 degrees and the primary piston is at Bottom Dead Centre (BDC). This is therefore the end of the power stroke and the beginning of the exhaust stroke. The secondary crankshaft has only rotated through 90 degrees and the secondary piston is still in its upward stroke and has not yet reached its TDC. The exhaust aperture 15 is so positioned in the second cylinder 8 that the secondary piston has now started to uncover the exhaust aperture 15. The rotary sealing valve 17 now also has opened, and exhaust gases 25 can now begin to flow out of the combustion space 12 through exhaust aperture 15 and exhaust port 16. Since the lowermost part of the exhaust aperture 15 is constructed so as to be slightly lower than the lowermost part of the inlet aperture 14, the inlet aperture 14 has not at this stage been uncovered by secondary piston 7.

Figure 4:
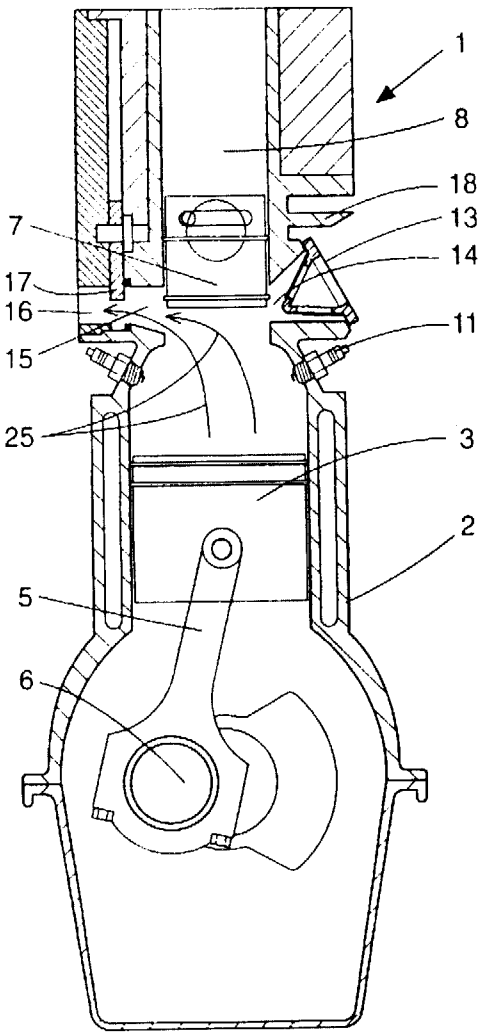
FIG. 4 is the cross-section of the engine as in FIG. 1 but with the first crankshaft at 270 degrees rotation.

FIG. 4 shows the engine 1 with the first crankshaft 6 at 270 degrees. The second crankshaft 10 has undergone 135 degrees of rotation and both the inlet aperture 14 and the exhaust aperture 15 are now partly uncovered by the secondary piston 7. The primary piston is approximately half-way through its exhaust stroke and acts so as to push out the burnt fuel/exhaust gases 25 from the combustion space through the exhaust aperture and out through the exhaust port 16. The inlet valve, being a one-way valve such as a reed valve, does not allow any of the exhaust gases 25 to flow out through the inlet aperture.

Figure 5:
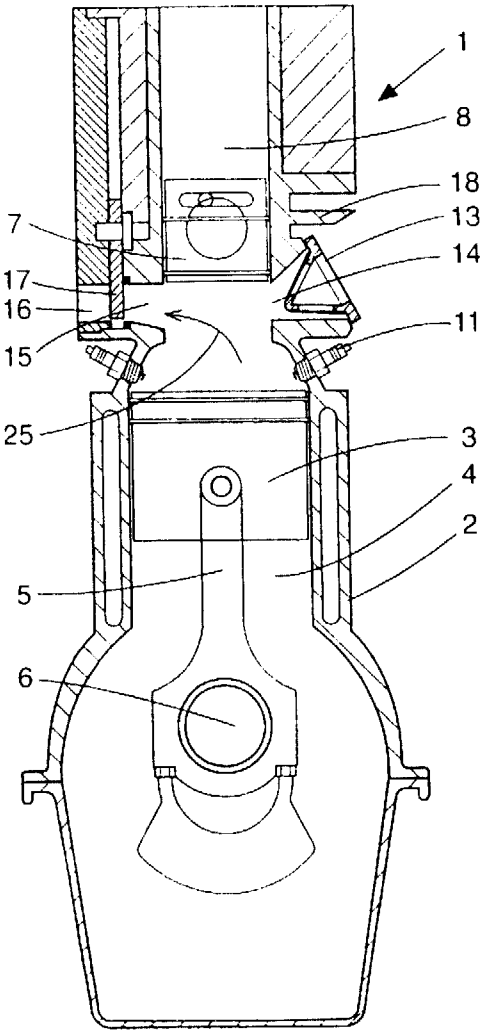
FIG. 5 is the cross-section of the engine as FIG. 1 but with the first crankshaft at approximately 360 degrees rotation.

FIG. 5 shows the engine when the first crankshaft has rotated through 360 degrees and the primary piston is once again at TDC but this time at the end of the exhaust stroke and at the beginning of the intake stroke. The second crankshaft has now rotated through 180 degrees with the secondary piston being approximately at 20 degrees before its TDC (because it was 20 degrees before its BDC when the primary piston was at TDC at the beginning of the power stroke). The lower most surface of the secondary piston is approximately level with the uppermost part of the exhaust aperture to avoid creating any chamber to trap exhaust gases. The exhaust sealing valve 17 has also just about closed the exhaust port 16 since most of the exhaust gases 25 would have by now been expelled from the combustion chamber 12.

Figure 6:
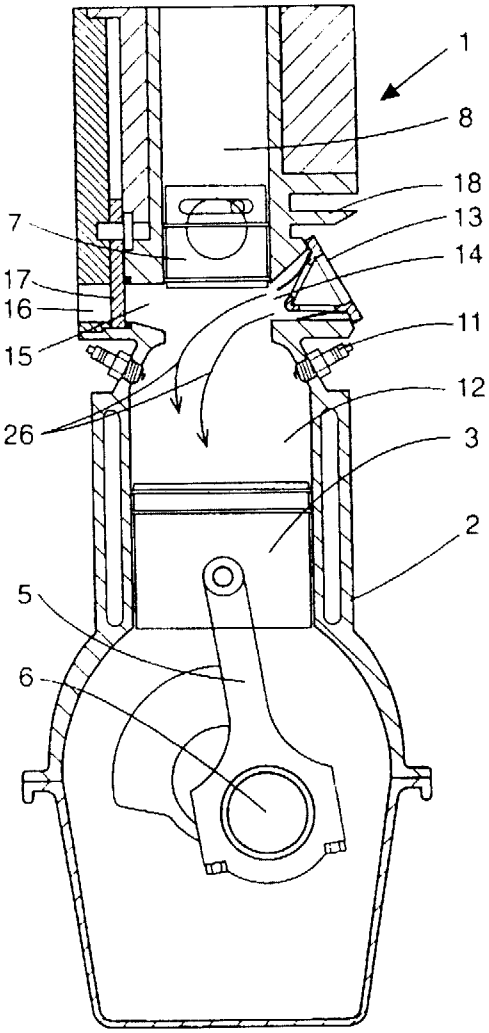
FIG. 6 is the cross-section of the engine as in FIG. 1 but with the first crankshaft at 490 degrees rotation.

FIG. 6 shows the engine when the first piston is half-way through its intake stroke with the first crankshaft having rotated through 490 degrees. As the first piston 3 moves downwards, there is a suction effect produced by the expansion of the combustion chamber and the combustion space 12 is charged by a fresh air/fuel mixture 26 drawn through inlet reed valve 13. During the beginning of the intake stroke the inlet aperture 14 is fully open unlike the case of the conventional poppet valve engine thereby resulting in an improved volumetric efficiency. The expelled exhaust gases are prevented from re-entering the combustion space 12 by the now closed rotary exhaust sealing valve 17. This is important for the movement of the primary piston causes the pressure in the combustion chamber to fall below atmospheric pressure and this sucking motion charges the combustion chamber with fresh fuel/air mixture through the inlet valve. If the rotary disc valve were not present then some of the expelled exhaust gases would also be sucked back into the combustion chamber through the exhaust aperture. This obviously would lead to less efficiency since the air/fuel mixture would be mixed with burnt exhaust gases. It is therefore critical that the exhaust port is closed by any suitable means whilst the engine is in the intake stroke so as to avoid the re-entering of the burnt exhaust gases into the combustion chamber.

Figure 7:
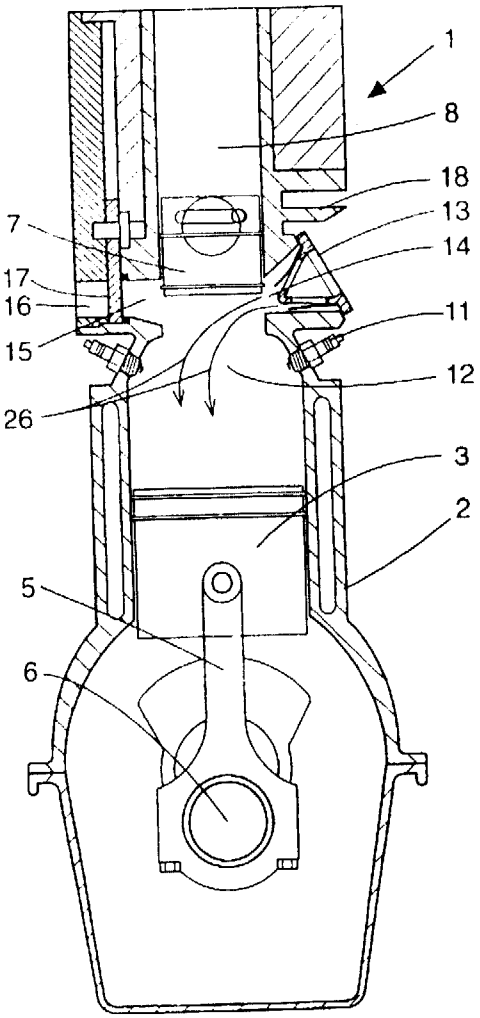
FIG. 7 is the cross-section of the engine as in FIG. 1 but with the first crankshaft at approximately 540 degrees rotation.

FIG. 7 shows the end of the intake stroke when the first piston 3 is at BDC, the first crankshaft 6 now having rotated through 540 degrees, while the second crankshaft 10 has rotated through 270 degrees and the second piston 7 is in its down stroke towards its BDC. The secondary piston has now partially covered both the inlet and exhaust apertures. The primary piston 3 is now at the beginning of the compression stroke and the rotary disc valve is still covering the exhaust port.

Figure 9:
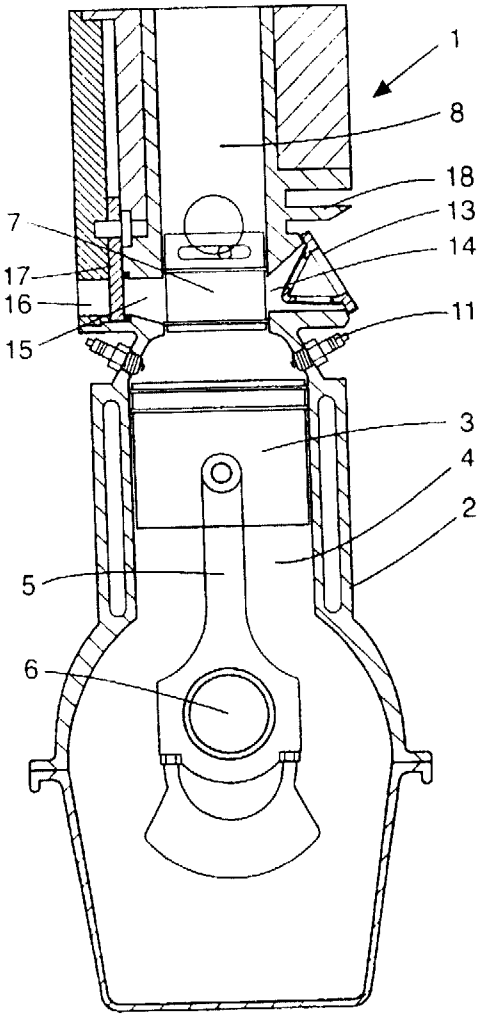
FIG. 9 is the cross-section of the engine as in FIG. 1 but with the first crankshaft at 720 degrees rotation.
Figure 8:
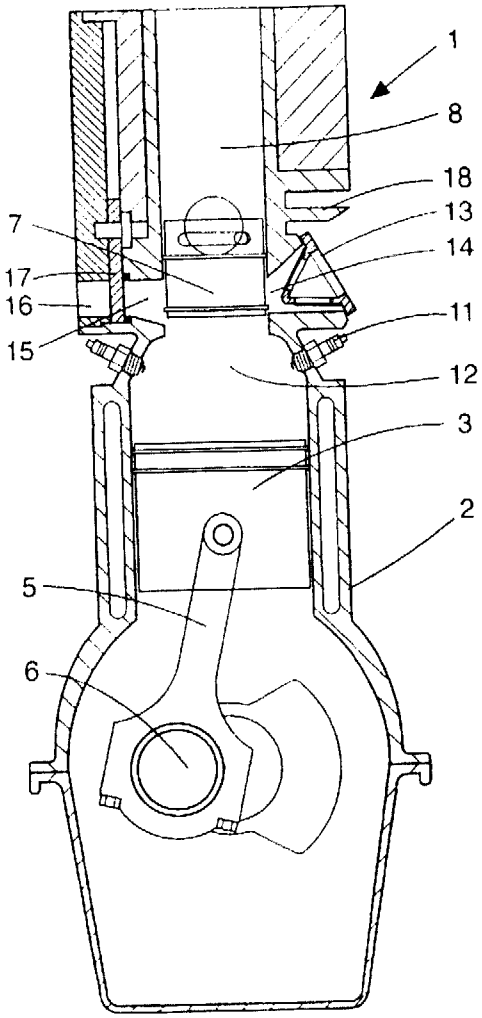
FIG. 8 is the cross-section of the engine as in FIG. 1 but with the first crankshaft at 630 degrees.

FIG. 8 shows the engine when the primary piston is half-way through its compression stroke, the first crankshaft having rotated through 630 degrees, the second crankshaft having rotated through 315 degrees, the secondary piston is about half-way through its downward stroke. The secondary piston is substantially covering the exhaust and inlet apertures. As the first piston 3 moves upwards and the second piston 7 moves downwards the combustion space 12 decreases in volume causing the air/fuel mixture to be compressed so that at the end of the compression stroke, as shown in FIG. 9, the combustion space 12 is substantially minimised. FIG. 9 is essentially FIG. 1 with the primary piston 3 being at TDC and the secondary piston 20 degrees before BDC. At this point the spark plugs 11 ignite the air/fuel mixture and the cycle begins once again.

Figure 10:
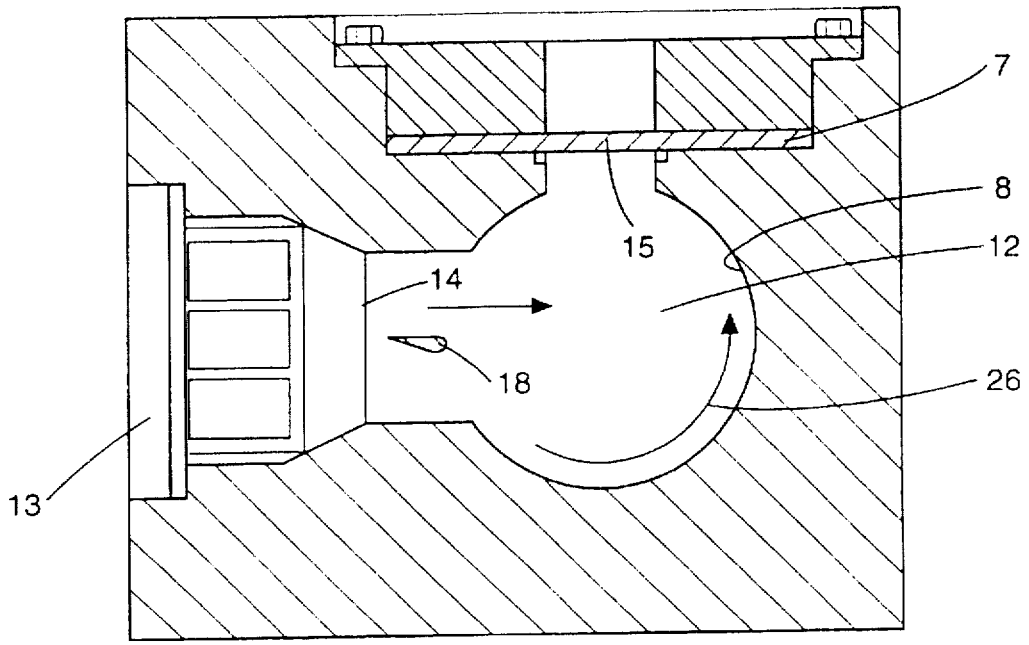
FIG. 10 is a cross-sectional view of the cylinder head showing the intake and exhaust ports as well as the exhaust rotary disc valve.

FIG. 10 is a cross-sectional view of the engine through the second cylinder 8, showing the inlet aperture 14, the exhaust aperture 15, the reed valve 13, and the exhaust rotary valve 17. The inlet aperture 14 may preferentially include a dividing part 18 which acts to impart a higher velocity swirl to the air/fuel mixture 26 around the outer areas of the combustion space 12 and a lower velocity to the inside areas or the combustion chamber thereby aiding in the combustion process. However it is to be understood that the engine is not limited to a particular air/fuel charging means, and various features may be changed to improve the combustion process, such as fuel injection, or using a rotary disc inlet valve.

Figure 11:
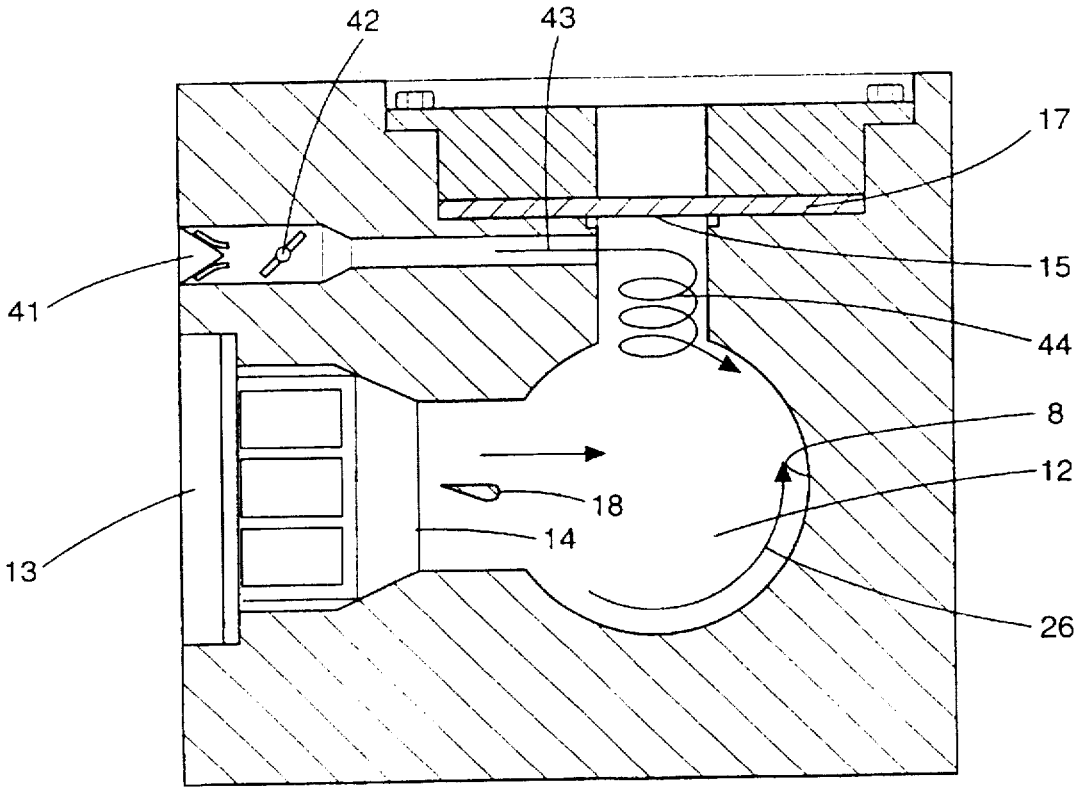
FIG. 11 is a cross sectional view of the cylinder head as in FIG. 10 but with in combination with a small tube/passageway containing a butterfly valve and small reed valve.

FIG. 11 shows the cross sectional view of the engine as in FIG. 10 showing the second cylinder 8, the inlet aperture 14, the exhaust aperture 15, the reed valve 13, the exhaust rotary valve 17, and the combustion chamber 12. However, FIG. 11 also includes an additional feature that may be employed to enhance the operation of this engine. That is, there is a stratified charge tube 40 containing a small reed valve 41, butterfly valve 42 the stratified charge tube allowing air/fuel mixture 43 to enter the combustion space in a swirling motion 44, and in an opposite direction to the main air/fuel mixture 26. It is to be understood however that this is only an additional feature that may be employed to improve the homogeneity of the air/fuel mixture and does not need to be used to perform the invention.

Figure 12:
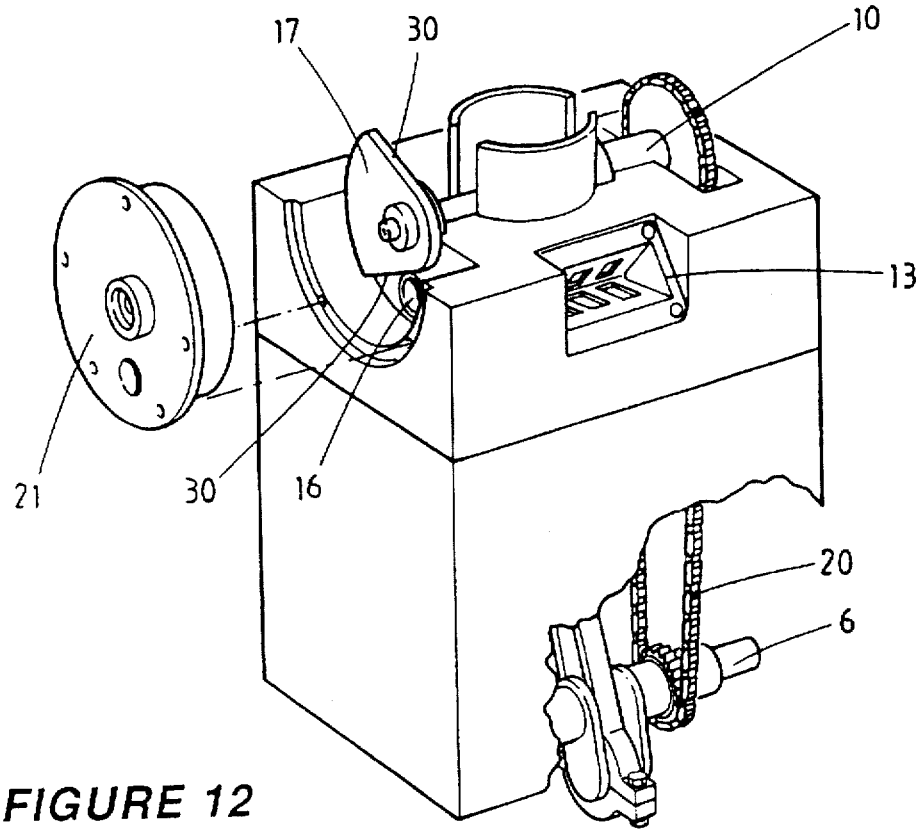
FIG. 12 is an isometric view of one of the preferred embodiments of the engine with a reed inlet valve and a rotary disc exhaust valve.

FIG. 12 is an isometric view of the engine showing the first crankshaft 6, the second crankshaft 10, the chain drive 20 connecting the said first crankshaft 6 to the said second crankshaft 10, the one way-inlet valve being a reed valve 13, the rotary exhaust sealing valve 17, the exhaust port 16 and the exhaust bearing holder cap (manifold) 21.

The rotary sealing valve is held in position by a compression spring (not shown) which acts so as to push the rotary valve onto against the exhaust port. To aid in this and to reduce frictional losses the exhaust port may include a slight protrusion. The exhaust protrusion is therefore the portion of the exhaust port that may be in contact with the rotary sealing disc valve which may be simply a flat plate so shaped to allow the exhaust port to be opened or closed depending on the rotation of the first and second crankshafts. It is to be understood that the rotary sealing valve 17 acts to prevent the back flow of the exhaust gases into the combustion chamber through the intake part of the engine cycle. The rotary disc valve may be driven directly by the second crankshaft 10 so that its opening and closing of the exhaust port can be finely tuned. The shape of the rotary disc valve 17 may also be varied according to the particular requirement. Thus, although in FIG. 12 the rotary disc valve 17 is shown as a flat plate with at least two straight edges 30, those straight edge passing across the exhaust port 16 so as to open and close it, the shape of the edges may be varied and may include but not be limited to curved edges which act to quicker cover and uncover the exhaust port.

The positioning and size of the inlet aperture 14 and the exhaust aperture 15 can all be varied to suit particular requirements. In FIGS. 1–9 the inlet aperture 14 is shown as being substantially opposite the exhaust aperture 15. However, this is only for schematic purposes and one of the more appropriate position is shown in FIG. 10 and 11, where the relative position of the apertures is such that there centre axis are substantially at 90 degrees to each other. The apertures may also be placed at different vertical positions in the cylinder wall with respect to the combustion space thus making the valve timing and compression ratio variable. It is to be also understood that there may be more than one inlet or exhaust aperture, similarly to the multi-valve conventional poppet engines that are well known.

Figure 13:
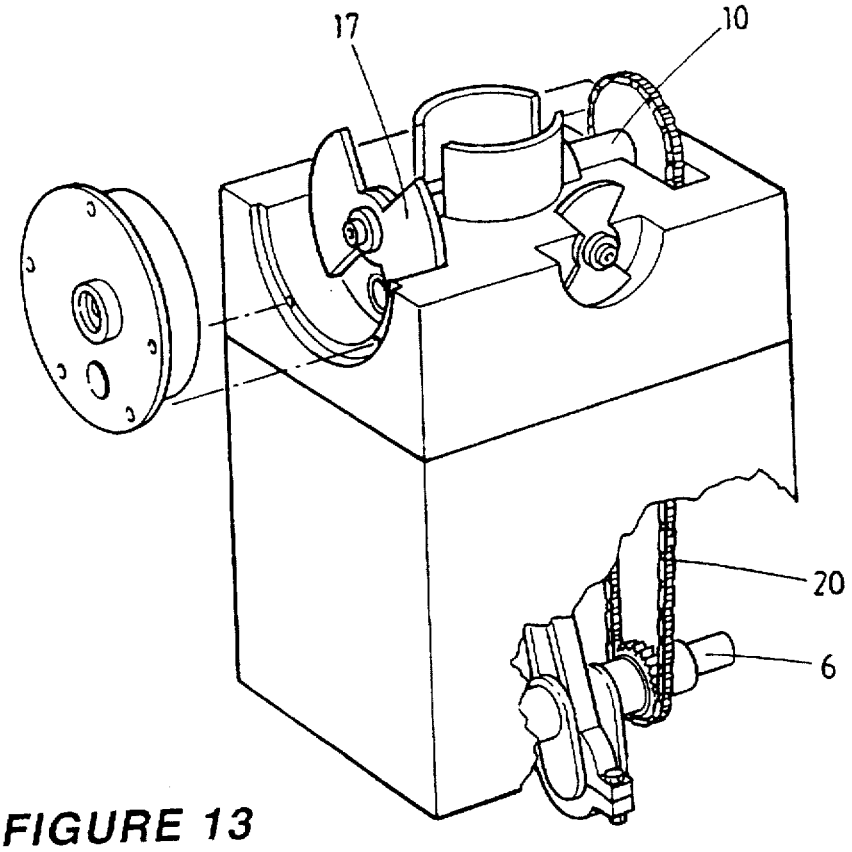
FIG. 13 is an isometric view of the engine as in FIG. 12 but with counterbalanced rotary disc-valves used for both the intake and outlet valves.

FIG. 13 is an isometric view of the engine as in FIG. 12 but with both the inlet valve and the exhaust valve being rotary sealing valves. This requires there to be an additional rotational driving mechanism (not shown) that opens and closes the inlet valve at the appropriate part of the engine cycle.

FIG. 13 further shows the rotary valves being counterbalanced to minimise vibrational effects within the engine. The actual shape of the rotary valves isnot relevant, what is critical is that they cover and uncover the inlet and exhaust ports at the right time in the cycle. Thus in the case of the exhaust aperture the exhaust port must be substantially opened through the exhaust cycle, that is when the first crankshaft is in the 180 to 360 degrees rotation, and it must be substantially closed through the intake cycle, that is 360 to 540 degrees. Of course, because the intake cycle follows the exhaust cycle it is impossible to instantly close the port at 360 degrees, and this is where the shape of the rotary disc valve can play a significant part. It may be even advantageous to have the exhaust port uncovered at the beginning of the intake cycle or otherwise, however, these are facts that may be changed when the engine is being tuned for different operating requirements. Thus, as discussed below, a racing engine will be tuned differently to a normal engine.

It is to be understood that the relative size of the sealing valves is unimportant and various sizes may be employed to suit various engine designs. In addition when the sealing valves are of the counter balanced construction as shown here then the drive ratio of the valves may be 4:1 as compared with the main crankshaft speed.

Figure 14:
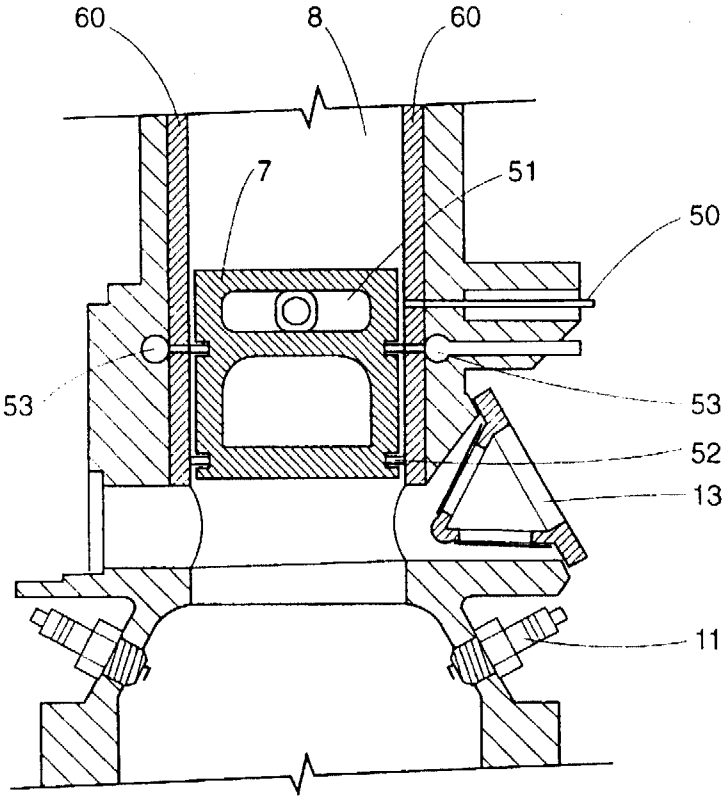
FIG. 14 is a cross-sectional view of one preferred embodiment of the engine showing a typical oil supply architecture for the upper secondary piston.

FIG. 14 is a typical example of an oil system for the secondary or upper piston 7. The cylinder 8 within which the piston slides usually includes a sleeve 60 which is manufactured from a hard-wearing material such as cast-iron. Through this sleeve there is an oil pressure feed 50 which, feeds oil to the secondary piston and cylinder as well as to the slide 51 of the scotch-yoke of the upper piston. The upper piston includes at least one (but preferentially more) scraper ring 52 which acts so as to scrape the oil off the sleeves 60. The oil (not shown) is extracted by the use of a ring-shaped cavity 53 outside of the cast sleeve 60. The scraper ring 52 is substantially level with the scraper ring when the secondary piston is at its TDC. A series of holes are drilled through the sleeve as well as the secondary piston. An extractor pump (not shown) draws oil gathered by the scraper ring 52 as well as small quantities of air from the inside of the piston and return it to the sump or oil holding tank (not shown).

Figure 15:
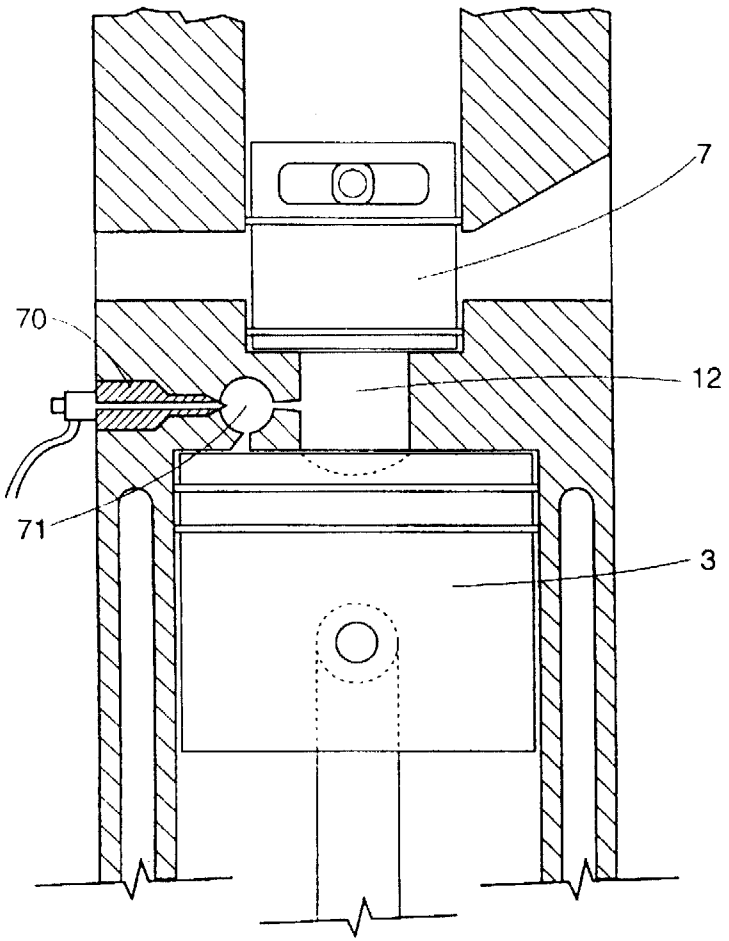
FIG. 15 is a cross-sectional view of the invention when employed on a diesel type engine.

FIG. 15 shows the invention when used for a diesel type engine. These types of engines usually work without the aid of a spark plug and rely on the fact that diesel fuel will ignite when subjected to a particular pressure. Generally diesel engines compress the air and the fuel is injected into already pressurised air. Since it is therefore the total volume into which the air/fuel mixture is compressed that is important the combustion space 12 may be designed to be smaller by suitable construction,. In this particular case, the combustion chamber is made smaller by making the pistons substantially covering the respective cylinders and leaving only a small combustion space therebetween. The fuel is introduced into the chamber via injectors 70, and there may be a further secondary combustion chamber 71 which aids in the efficient operation of the engine.

Figure 16:
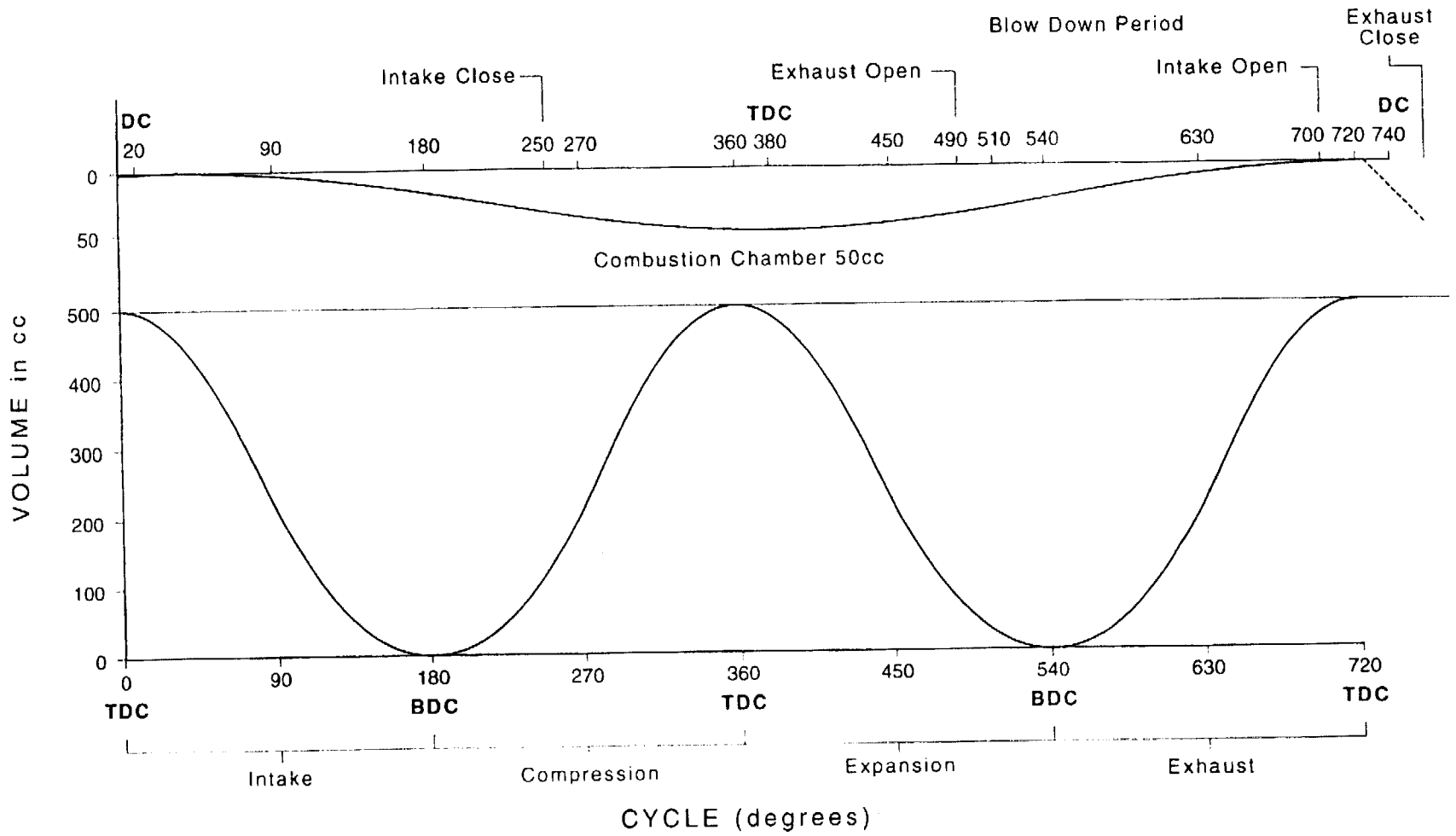
FIG. 16 is graph showing the relative positions of the primary and secondary cylinders as a function of a complete cycle.

FIG. 16 is a graph showing the relative positions of the primary and secondary piston when the secondary piston as tuned so as to be 20 degrees BDC whilst the primary piston is at TDC. In addition, there is shown on the graph the relative timings of the opening and closing of both the intake and the exhaust ports. The y-axis refers to a particular volume in cubic centimetres, due to empirical research, particularly a motorbike engine. However, it is not intended to limit this invention to any particular size or to any relative size of the primary to the secondary piston or stroke. This graph is intended to show only one typical example of an engine which was found to satisfactorily work.

Thus there are a number of advantages in an engine the subject of this invention as compared with conventional internal combustion engines that operate one piston per cylinder. The loads on the first crankshaft or the main crankshaft of an engine constructed as taught by this invention are reduced overall as compared with those in a standard engine during the compression and expansion strokes. Thus the loads at TDC compression would be marginally smaller, at 10 degrees ATDC they would be greater, at 20 degrees ATDC would be about equivalent, whilst thereafter they would be smaller. The reduction of the load should result in less friction in the main crankshaft assembly. Thus assuming that the frictional characteristics of this engine as compared to a standard one are about the same, the reduction of the load should lead to greater mechanical efficiency.

A further advantage of this invention is that the head should absorb less heat than a standard head. The significant area being the exhaust. In conventional engines, the poppet exhaust valve is directly in the path of gas flow and there is considerable turbulence as the exhaust gasses pass out of the cylinder. The temperature of the poppet valve may thus reach over 1000 degrees Centigrade. The flow out of the head as disclosed in this invention is less turbulent as there is not metal protrusion in the gas flow. The resulting gas flow is thus less turbulent, and looses less heat than a convention engine. This has the further advantage in that the light up time for the catalytic converter found in most engines these days is reduced. A further advantage that may occur is that due to less turbulence, the head absorbs less heat and the incoming charge density of the air/fuel mixture may be greater. The reduction of turbulence also leads to less pumping losses.

Another advantage of this invention is that the exhaust port is continuously being further exposed (enlarged) this continuing nearly towards the end of the stroke when the rotary disk comes into action. This may be compared with the standard engine poppet valve which starts reducing the gas flow at around 600 degrees of the stroke cycle, at which point its maximum, lift is reached. This invention enables the maximum exhaust port area to occur at 710 degrees. Furthermore, the nature of the exhaust opening also tends to reduce any acoustical noise level. The larger opening for the exhaust port allows more use of the kinetic energy up the column of the exhausts gasses and creates a negative pressure in the combustion chamber.

In racing engines where excess fuel consumption and excess hydrocarbons are not an issue this kinetic energy may be used in a similar manner to two-stroke engines. To enhance this process, the closing of the disk valve should be ideally left to later in the cycle, say approximately at 70 degrees ATDC on the intake stroke. In this instance, a portion of the intake mixture follows the exhaust column and may fill the first several centimetres of the exhaust pipe. Thus in a multi-inlet port engine there may be one intake port positioned substantially opposite an exhaust port in the upper cylinder wall so as to direct an intake stream across the combustion chamber at the exhaust port whilst the other intake ports are directed away from the exhaust port down the cylinder.

To add more kinetic energy to the process the exhaust should be open earlier at approximately 460 degrees. But also to widen the window of opportunity between when the intake port is closed and the exhaust port is closed, at approximately 250 to 300 degrees instead of 250 to 270 degrees. The trailing edge of the rotary disk should be timed to open the exhaust port again At approximately 240 degrees, this allowing the reverse pressure pulse from the two stroke style exhaust to ram the first 50 to 75 mm (2–3 inches) of intake mixture in the exhaust pipe back into the combustion chamber before the exhaust port is closed. An engine of this design would not idle very well but should produce good power at higher rotation speeds.

A yet further advantage in this engine is that there is a residual pressure in the cylinder before the exhaust valve is opened. In the standard engine work is expanded by the cam to unseat the exhaust valve against this pressure (that pressure usually being of the order of 50–70 pounds per square inch). However, in the engine the subject of this invention, this pressure is utilized to do work via the upper piston. If the upper piston has an area of approximately 3000 square millimetres (4.5 inches square), this results in a force of up to 400 hundred pounds, although 300–340 is more likely because of lower pressures due to the greater expansion stroke. However, the combustion has been shifted slightly so as to occur later in the cycle so the actual physical properties are yet to be determined accurately.

Turning now to the reed valve, its use confers an advantage in that intake occurs whenever pressures or the kinetic energy of intake or exhaust column dictate. But also the reed valve causes the gas velocity to be greater than normal at low throttle settings promoting good swirl which further aids in atomising the fuel. This therefore acts somewhat as a pseudo second venturi.

Referring now to the crankshaft motions, in prior art the upper piston reaches its TDC well in advance of the main piston. This invention however teaches that even if the stroke is variable the upper piston does not reach its TDC before the main piston. A further additional feature of this engine that may be used and is used so as to minimise the space requirements (specifically the vertical extent caused by the second piston) is that the head faces away from the main piston crown, os in another embodiment may be a scotch yoke. Both of these imparts a different motion to the upper piston than has been taught in other prior art and results in the piston acceleration being slower than in the head as described above or a scotch yoke. Thus mechanically it is easier to achieve a TDC of the upper piston after the main piston has reached TDC.

There are three main reasons for desiring the main piston to reach TDC prior to the secondary piston. Firstly this allows more advantageous timing as fas as the opening the ports and closing the intake. Secondly this maintains a longer period of relatively constant (or close to) volume during which combustion can occur. Thirdly it places peak cylinder pressure later in the expansion phase.

The most advantageous timing would of course vary for different engine designs. Thus one could vary the TDC coincidence from 1 to 40 degrees, depending on the particular engine and particular application.

The above description is not intended to limit the invention to that description only. Various changes may be made to the above embodiments so illustrated and described without deviating from the spirit of this invention.

I claim:

1. An internal combustion engine comprising of;

two cylinders co-axially aligned and meeting to form a combustion space therebetween;

a first piston adapted to reciprocate within the first cylinder;

a second piston adapted to reciprocate within the second cylinder;

the two pistons being drivably coupled so as to synchronously move one with respect to the other such that the second piston moves at a frequency half of that of the first piston;

means for providing for an air/fuel mixture inlet through a first aperture or apertures in the wall of the second cylinder;

means for providing an exhaust outlet through a second aperture or apertures in the wall of the second cylinder;

a timed exhaust sealing valve within the exhaust outlet to effect an opening or closing of the exhaust outlet at a selected time in the operating cycle of the engine; and the apertures being positioned so as to be opened or closed by covering and uncovering of the apertures by the movement of the second piston.

2. An internal combustion engine as in claim 1 wherein the exhaust sealing valve is a disc-type rotary valve.

3. An internal combustion engine as in claim 1 wherein at least a part of the second aperture or apertures is so positioned on the wall of the second cylinder whereby when the part is uncovered by the second piston the second piston covers all of the inlet aperture or apertures.

4. An internal combustion engine as in claim 3 wherein the part of the second aperture or apertures is located lower on the wall of the second cylinder than the first aperture or apertures.

5. An internal combustion engine as in claim 1 wherein the exhaust outlet includes a protrusion which protrudes somewhat from the body of the cylinder resulting the disc-type rotary valve only contacting against that protrusion.

6. An internal combustion engine as in claim 5 wherein the protrusion is ceramic, although other suitable materials such as brass may be employed.

7. An internal combustion engine as in claim 1 wherein the air-fuel mixture inlet further comprises a one-way inlet valve.

8. An internal combustion engine as in claim 1 wherein the inlet valve is a reed valve.

9. An internal combustion engine as in claim 1 wherein the exhaust and inlet apertures are substantially circular in shape.

10. An internal combustion engine as in claim 1 wherein the exhaust and inlet apertures are substantially non-circular in shape, such as but not limited to elliptical.

11. An internal combustion engine as in claim 1 wherein there is at least one spark plug adapted to ignite the air/fuel mixture in the combustion space.

12. An internal combustion engine as in claim 1 wherein the engine is adapted to use diesel fuel which ignites due to compression.

13. An internal combustion engine as in claim 1 wherein there is a secondary air/fuel inlet aperture so positioned to effect the air/fuel to enter the combustion space in a swirling motion and thereby act so as to cause a preferential charging of the combustion space, whereby the motion of the air/fuel mixture from the secondary air/fuel aperture is in a direction substantially different to that entering the combustion chamber through the main air/fuel inlet aperture.

14. An internal combustion engine as in claim 1 wherein the second piston is cylindrical and has a diameter which is between 50 to 70 percent of the diameter of the first piston.

15. An internal combustion engine as in claim 1 wherein the length of the stroke of the second piston is between 25 to 50 percent the length of the stroke of the first piston.

16. An internal combustion engine as in claim 1 wherein the crown of the first piston is substantially flat so as to minimise thermal losses.

17. An internal combustion engine as in any one of claim 1 wherein the crown of the piston is shaped to affect the compression ratio.

18. An internal combustion engine as in claim 1 wherein the crown of the second piston is substantially conical.

19. An internal combustion engine as in claim 1 wherein the first piston is connected to a first crankshaft, the second piston is connected to a second crankshaft, the first and the second crankshaft drivably coupled to each other whereby the second crankshaft rotates at an angular velocity half that of the first crankshaft.

20. An internal combustion engine as in claim 1 wherein the second piston is connected to a crankshaft which lies within the second piston skirt.

21. An internal combustion engine as in claim 20 wherein the second piston is connected to the crankshaft via a con-rod which faces away from the crown of the second piston.

22. An internal combustion engine as in claim 1 wherein the cooling of the engine is accomplished by conventional means such as water-cooling or air-cooling.

23. An internal combustion engine as in claim 1 wherein the disc type rotary valves can be used with both the inlet and the exhaust outlets.

24. An internal combustion engine as in claim 19 wherein the exhaust rotary disc valve is substantially open through most of the rotation of the first crankshaft of between 180 to 360 degrees, the exhaust stroke.

25. An internal combustion engine as in claim 19 wherein the exhaust rotary disc valve is substantially closed through most of the rotation of the first crankshaft of between 360 to 540 degrees, the intake stroke.

26. An internal combustion engine as in claim 19 wherein the maximum exhaust port area occurs substantially at 710 degrees of rotation of the first crankshaft.

27. An internal combustion engine as in claim 19 wherein the rotary sealing valve is fully closed at 70 degrees rotation of the first crankshaft.

28. An internal combustion engine as in claim 19 wherein the second cylinder causes the inlet aperture to be closed at 250 degrees rotation of the first crankshaft.

29. An internal combustion engine as in claim 19 wherein the second cylinder causes the inlet aperture to be open when the first crankshaft rotation is between 250 to 700 degrees.

* * * * *